US006301959B1

(12) United States Patent
Hrametz et al.

(10) Patent No.: US 6,301,959 B1
(45) Date of Patent: Oct. 16, 2001

(54) FOCUSED FORMATION FLUID SAMPLING PROBE

(75) Inventors: Andrew A. Hrametz, Rosenberg; Clarence C. Gardner, Georgetown, both of TX (US); Margaret C. Waid, Baton Rouge, LA (US); Mark A. Proett, Missouri City, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/236,993

(22) Filed: Jan. 26, 1999

(51) Int. Cl.[7] ..... E21B 47/10; E21B 47/01; G01V 3/18

(52) U.S. Cl. ..... 73/152.23; 73/152.01; 73/152.31; 166/250.17; 166/264

(58) Field of Search ..... 73/152.01, 152.23, 73/152.21, 152.31, 152.46; 166/254.2, 250.17, 264

(56) References Cited

U.S. PATENT DOCUMENTS

| | | | | |
|---|---|---|---|---|
| 2,189,919 | * | 2/1940 | Moore | 166/1 |
| 2,503,557 | * | 4/1950 | McKinley | 166/1 |
| 2,623,594 | * | 12/1952 | Sewell | 166/1 |
| 2,747,401 | | 5/1956 | Doll | 73/151 |
| 3,323,361 | * | 6/1967 | LeBourg | 73/155 |
| 3,530,711 | * | 9/1970 | Tocanne | 73/155 |
| 3,611,799 | | 10/1971 | Davis | 73/155 |
| 3,762,219 | * | 10/1973 | Jessup | 73/155 |
| 3,969,937 | * | 7/1976 | Barrington et al. | 73/151 |
| 4,392,376 | * | 7/1983 | Lagus et al. | 73/155 |
| 4,416,152 | | 11/1983 | Wilson | 73/155 |
| 4,635,717 | * | 1/1987 | Jageler | 166/250 |
| 4,860,581 | | 8/1989 | Zimmerman et al. | 73/155 |
| 5,219,388 | * | 6/1993 | Meletiou et al. | 73/155 |
| 5,230,244 | * | 7/1993 | Gilbert | 73/155 |
| 5,337,838 | * | 8/1994 | Sorensen | 175/59 |
| 5,831,156 | * | 11/1998 | Mullins | 73/152.18 |

* cited by examiner

*Primary Examiner*—Hezron Williams
*Assistant Examiner*—David Wiggins
(74) *Attorney, Agent, or Firm*—Conley, Rose & Tayon

(57) ABSTRACT

A formation fluid sampling probe uses two hydraulic lines to recover formation fluids from two zones in a borehole. One of the zones is a guard zone and the other is a probe zone. The guard zone and the probe zone are isolated from each other by mechanical means, with the guard zone surrounding the probe zone and shielding it from the direct access to the borehole fluids. Operation of the tool involves withdrawal of fluid from both zones. Borehole fluids are preferentially drawn into the guard zone so that the probe zone recovers the formation fluid substantially free of borehole fluids. Separation of the guard zone from the probe zone may be accomplished by means of an elastomeric guard ring, by inflatable packers or by tubing. The device can be adapted for use either on a wireline or in an early evaluation system on a drillstring.

47 Claims, 5 Drawing Sheets

FOCUSED FORMATION FLUID SAMPLING PROBE

FIELD OF THE INVENTION

The invention relates generally to formation fluid testing and collection apparatus and more particularly to a formation tester that reduces the contamination caused by borehole fluids in recovered formation fluids.

BACKGROUND OF THE INVENTION

In the oil and gas industry, formation testing tools have been used for monitoring formation pressures along a wellbore, obtaining formation fluid samples from the wellbore and predicting performance of reservoirs around the wellbore. Such formation testing tools typically contain an elongated body having an elastomeric packer that is sealingly urged against the zone of interest in the wellbore to collect formation fluid samples in storage chambers placed in the tool.

During drilling of a wellbore, a drilling fluid ("mud") is used to facilitate the drilling process and to maintain a pressure in the wellbore greater than the fluid pressure in the formations surrounding the wellbore. This is particularly important when drilling into formations where the pressure is abnormally high: if the fluid pressure in the borehole drops below the formation pressure, there is a risk of blowout of the well. As a result of this pressure difference, the drilling fluid penetrates into or invades the formations for varying radial depths (referred to generally as invaded zones) depending upon the types of formation and drilling fluid used. The formation testing tools retrieve formation fluids from the desired formations or zones of interest, test the retrieved fluids to ensure that the retrieved fluid is substantially free of mud filtrates, and collect such fluids in one or more chambers associated with the tool. The collected fluids are brought to the surface and analyzed to determine properties of such fluids and to determine the condition of the zones or formations from where such fluids have been collected.

One feature that all such testers have in common is a fluid sampling probe. This may consist of a durable rubber pad that is mechanically pressed against the rock formation adjacent the borehole, the pad being pressed hard enough to form a hydraulic seal. Through the pad is extended one end of a metal tube that also makes contact with the formation. This tube ("probe") is connected to a sample chamber that, in turn, is connected to a pump that operates to lower the pressure at the attached probe. When the pressure in the probe is lowered below the pressure of the formation fluids, the formation fluids are drawn through the probe into the well bore to flush the invaded fluids prior to sampling. In some prior art devices, a fluid identification sensor determines when the fluid from the probe consists substantially of formation fluids; then a system of valves, tubes, sample chambers, and pumps makes it possible to recover one or more fluid samples that can be retrieved and analyzed when the sampling device is recovered from the borehole.

It is critical that only uncontaminated fluids are collected, in the same condition in which they exist in the formations. Commonly, the retrieved fluids are found to be contaminated by drilling fluids. This may happen as a result of a poor seal between the sampling pad and the borehole wall, allowing borehole fluid to seep into the probe. The mudcake formed by the drilling fluids may allow some mud filtrate to continue to invade and seep around the pad. Even when there is an effective seal, borehole fluid (or some components of the borehole fluid) may "invade" the formation, particularly if it is a porous formation, and be drawn into the sampling probe along with connate formation fluids.

In prior art operations, the pressure in the probe, and their connecting hydraulics flow line is lowered below the pressure of the fluid in the formation, drawing fluid from the formation into the probe, through the hydraulic flow line to the well bore. A fluid identification sensor may be installed in the hydraulic flow line, the fluid identification sensor producing a signal indicative of the composition of the fluid passing through it. When the fluid identification sensor determines that the fluid being pumped is primarily formation fluid, a sample chamber valve is opened and the sample chamber is filled.

Additional problems arise in Drilling Early Evaluation Systems (EES) where fluid sampling is carried out very shortly after drilling the formation with a bit. Inflatable packers or pads cannot be used in such a system because they are easily damaged in the drilling environment. In addition, when the packers are extended to isolate the zone of interest, they completely fill the annulus between the drilling equipment and the wellbore and prevent circulation during testing. Additionally, when an EES is used, there may be little or no mud cake formation prior to the test. A mud cake helps in sealing the formation from well bore fluids whereas in the absence of a mudcake, fluid leakage can be a serious problem. Pads are not adequate to provide a seal in the absence of a mudcake.

There is a need for an invention that reduces the leakage of borehole fluid into the sampling probe by isolating the probe from the borehole fluid. Such an invention should also reduce the amount of borehole fluid contaminating the connate fluid being withdrawn from the formation by the probe. Additionally, the invention should be able to sample formation fluids even when the mudcake is thin or non existent. There is a need for an invention that reduces the time spent on sampling and flushing of contaminated samples. The present invention satisfies this need.

SUMMARY OF THE INVENTION

One embodiment of the invention, suitable for use on a wireline, employs a hydraulic guard ring surrounding the probe tube to isolate the probe from the borehole fluid. The guard ring is provided with its own flow line and sample chamber, separate from the flow line and the sample chamber of the probe. By maintaining the pressure in the guard ring at or slightly below the pressure in the probe tube, most of the fluid drawn into the probe will be connate formation fluid. The same result is also obtained by using inflatable packer elements to create a guard ring above and below the sampling section. An alternate embodiment of the invention useful in Drilling Early Evaluation Systems uses two sets of seal elements are used to obtain an uncontaminated fluid sample. Two thin seals, such as the wall of a small pipe are employed to isolate two areas of the formation at the borehole wall: one between the inner and outer seals and the second in the center of the inner seal.

DETAILED DESCRIPTION OF THE INVENTION

Figure 1:
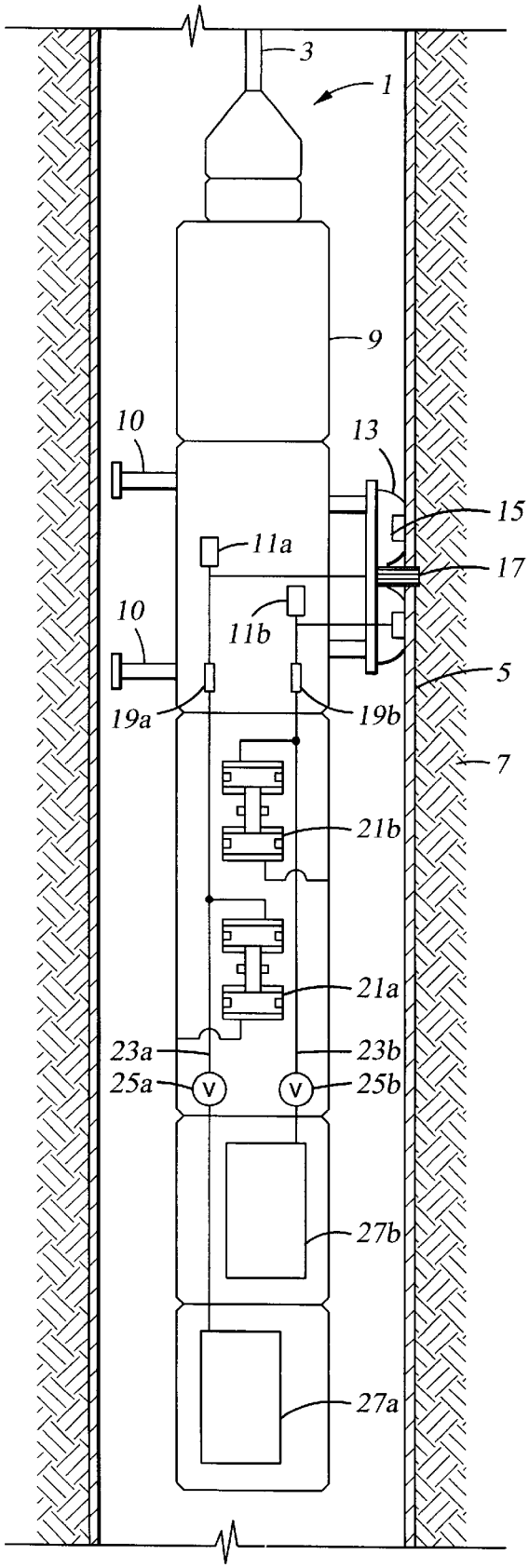
FIG. 1 is a simplified schematic illustration of an embodiment of the present invention.
Figure 2:
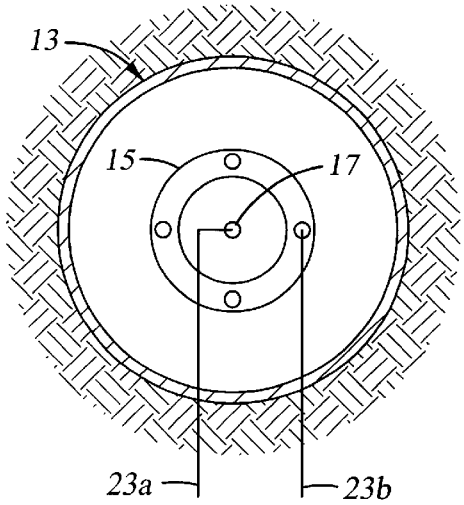
FIG. 2 shows a detail of the arrangement of the guard ring in the embodiment illustrated in FIG. 1.
Figure 3:
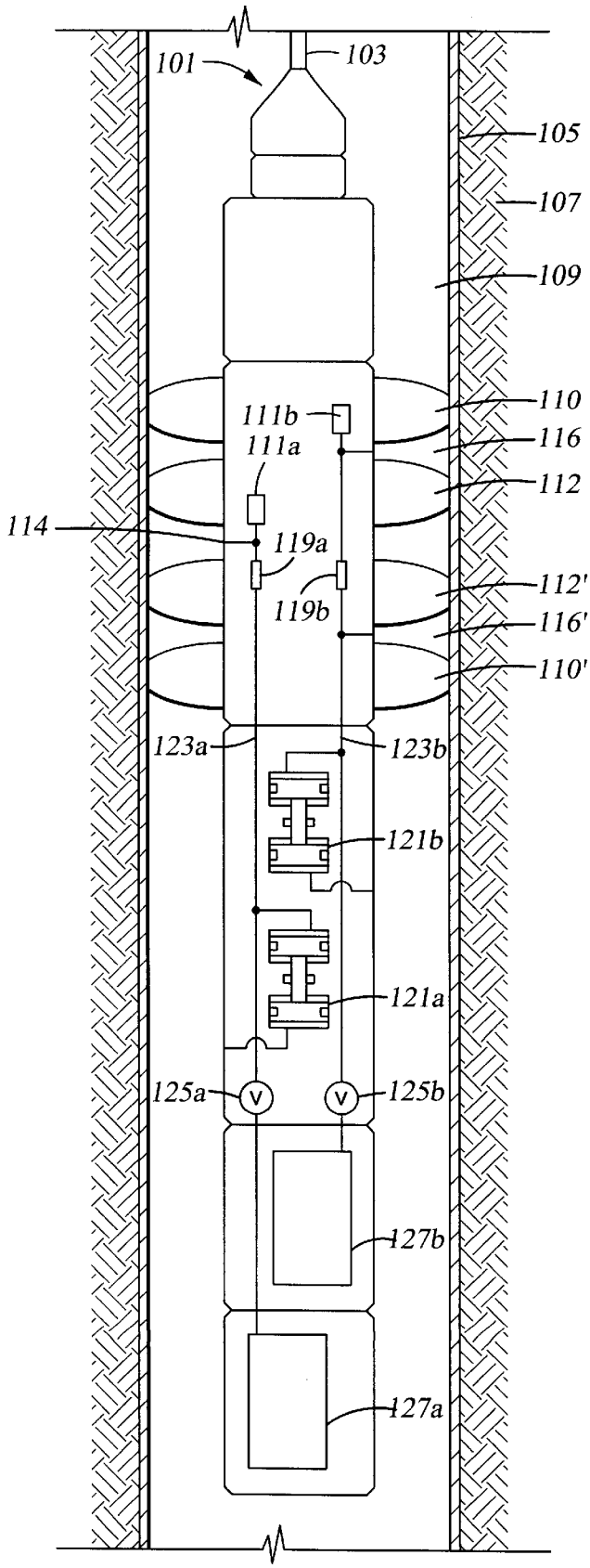
FIG. 3 is a simplified schematic illustration of an alternate embodiment of the present invention using inflatable packers on a wireline.

The present invention is best understood by reference to FIGS. 1–3. FIG. 1 is a schematic illustration of the preferred embodiment of the present invention. A portion of a borehole 1 is shown in a subterranean formation 7. The borehole wall is covered by a mudcake 5. The formation tester body 9 is connected to a wireline 3 leading from a rig at the surface (not shown). Alternatively, the formation tester body may be carried on a drillstring. The details of the method of connection of the tester body to a wireline or drillstring would be familiar to those versed in the art.

The formation tester body is provided with a mechanism, denoted by 10, to clamp the tester body at a fixed position in the borehole. This clamping mechanism is at the same depth as a probe and guard ring arrangement, details of which are seen in FIG. 2.

By means of the clamping mechanism, 10, a fluid sampling pad, 13, is mechanically pressed against the borehole wall. A probe tube, 17, is extended from the center of the pad, through the mud cake, 5, and pressed into contact with the formation. The probe is connected by a hydraulic flow line, 23*a,* to a probe sample chamber, 27*a*.

The probe is surrounded by a guard ring, 15. The guard ring is a hydraulic tube, formed into a loop, that encircles the probe. The guard ring has suitable openings along its length, the openings being in contact with the formation. The guard ring is connected by its own hydraulic flow line, 23*b*, to a guard sample chamber, 27*b*. Because the flow line 23*a* of the probe, 17, and flow line 23*b* of the guard ring, 15, are separate, the fluid flowing into the guard ring does not mix with the fluid flowing into the probe. The guard ring isolates the flow into the probe from the borehole beyond the pad 13. Thus three zones are defined in the borehole: a first zone consisting of the borehole outside the pad 13, a second zone (the guard zone) consisting of the guard ring 15 and a third zone (probe zone) consisting of the probe 17. The probe zone is isolated from the first zone by the guard zone.

The hydraulic flow lines 23*a* and 23*b* are each provided with pressure transducers 11*a* and 11*b*. The pressure maintained in the guard flowline is the same as, or slightly less than, the pressure in the probe flowline. With the configuration of the pad and the guard ring, borehole fluid that flows around the edges of the pad is preferentially drawn into the guard ring, 15, and diverted from entry into the probe, 17.

The flow lines 23*a* and 23*b* are provided with pumps 21*a* and 21*b*. These pumps are operated long enough to substantially deplete the invaded zone in the vicinity of the pad and to establish an equilibrium condition in which the fluid flowing into the probe is substantially free of contaminating borehole filtrate.

The flow lines 23*a* and 23*b* are also provided with fluid identification sensors, 19*a* and 19*b*. This makes it possible to compare the composition of the fluid in the probe flowline 23*a* with the fluid in the guard flowline 23*b*. During initial phases of operation of the invention, the composition of the two fluid samples will be the same; typically, both will be contaminated by the borehole fluid. These initial samples are discarded. As sampling proceeds, if the borehole fluid continues to flow from the borehole towards the probe, the contaminated fluid is preferentially drawn into the guard ring. Pumps 21*a* and 21*b* discharge the sampled fluid into the borehole. At some time, an equilibrium condition is reached in which contaminated fluid is drawn into the guard ring and uncontaminated fluid is drawn into the probe. The fluid identification sensors 19*a* and 19*b* are used to determine when this equilibrium condition has been reached. At this point, the fluid in the probe flowline is free or nearly free of contamination by borehole fluids. Valve 25*a* is opened, allowing the fluid in the probe flowline 23*a* to be collected in the probe sample chamber 27*a*. Similarly, by opening valve 25*b*, the fluid in the guard flowline is collected in the guard sample chamber 27*b*. The ability to pump from the guard ring into the guard sample chamber is one of the novel features of the invention: this results in an increased rate of flow from the formation into the probe and thereby improves the shielding effect of the guard ring. Alternatively, the fluid gathered in the guard ring can be pumped to the borehole while the fluid in the probe line is directed to the probe sample chamber 27*a*. Sensors that identify the composition of fluid in a flowline would be familiar to those knowledgeable in the art.

FIG. 3 shows an alternate embodiment of the invention. A portion of a borehole 101 is shown in a subterranean formation 107. The borehole wall is covered by a mudcake 105. The formation tester body 109 is connected to a wireline 103 leading from a rig at the surface (not shown). The details of the method of connection of the tester body to the wireline would be familiar to those versed in the art.

The formation tester body is provided with inflatable flow packers 112 and 112' and inflatable guard packers 110 and 110'. When the formation tester is at the depth at which formation fluids are to be sampled, the inflatable packers 110, 110', 112 and 112' are inflated to form a tight seal with the borehole wall and mudcake 105. The mechanism for activating the packers would be familiar to those versed in the art.

A hydraulic flow line (probe flowline) 123*a* is connected to an opening 114 in the tester located between the flow packers 112 and 112' and to a probe sample chamber 127*a*. This serves to sample formation fluid that flows into the borehole between the two flow packers. A second hydraulic flow line (guard flowline) 123*b* is connected to openings 116 and 116' in the tester located between the guard packer 110 and the flow packer 112 and between the guard packer 110' and flow packer 112' respectively. The guard flowline is connected to a guard sample chamber 127*b*. Thus three zones are defined in the borehole: a first zone consisting of the borehole above the packer 110 and below the packer 110', a second zone (the guard zone) consisting of the region between the packers 110 and 112 and between the packer 110' and 112'; and a third zone (probe zone) consisting of the zone between the packers 112 and 112'. The probe zone is isolated from the first zone by the guard zone.

The hydraulic flow lines 123*a* and 123*b* are each provided with pressure transducers 111*a* and 111*b*. The pressure maintained between each of the flow packers and the adjacent guard packer is the same as, or slightly less than, the pressure between the two flow packers. With the configuration of the guard and flow packers, borehole fluid that flows around the edges of the guard packers is preferentially drawn into the guard flowline 123*b*, and diverted from entry into the probe flowline 123*a*.

The flow lines 123*a* and 123*b* are provided with pumps 121*a* and 121*b*. These pumps are operated long enough to substantially deplete the invaded zone in the vicinity of the tool and to establish an equilibrium condition in which the fluid flowing into the probe flowline is substantially free of contaminating borehole filtrate.

The flow lines 123*a* and 123*b* are also provided with fluid identification sensors, 119*a* and 119*b*. This makes it possible to compare the composition of the fluid in the probe flowline 123*a* with the fluid in the guard flowline 123*b*. During initial phases of operation of the invention, the composition of the two fluid samples will be the same; typically, both will be contaminated by the borehole fluid. These initial samples are discarded. As sampling proceeds, if the borehole fluid continues to flow from the borehole towards the opening 114, the contaminated fluid is preferentially drawn into the openings 116 and 116'. Pumps 121*a* and 121*b* discharge the sampled fluid into the borehole. At some time, an equilibrium condition is reached in which contaminated fluid is drawn into the guard flowline and uncontaminated fluid is drawn into the probe flowline. The fluid identification sensors 119*a* and 119*b* are used to determine when this equilibrium condition has been reached. At this point, the fluid in the probe flowline is free or nearly free of contamination by borehole fluids. Valve 125*a* is opened, allowing the fluid in the probe flowline 123*a* to be collected in the probe sample chamber 127*a*. Similarly, by opening valve 125*b*, the fluid in the guard flowline is collected in the guard sample chamber 127*b*. The ability to pump from the guard ring into the guard sample chamber is one of the novel features of the invention: this results in an increased rate of flow from the formation into the probe and thereby improves the shielding effect of the guard ring.

Figure 4:
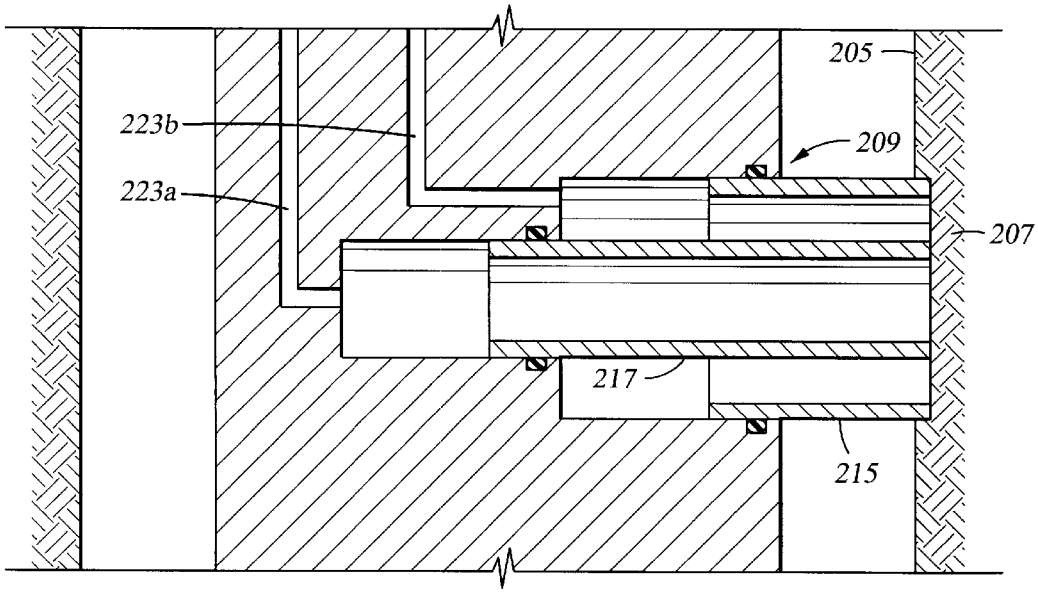
FIG. 4 is a simplified schematic illustration of an embodiment of the invention for use in a drilling Early Evaluation System using snorkel tubes.

FIG. 4 shows an alternate embodiment of the invention suitable for use in a drilling early evaluation system (EES). The borehole wall 205 in a formation 207 is indicated. The EES tool 209 is inside the borehole and attached to the drilling means (not shown). For simplicity of illustration, only one side of the EES tool is shown. Contact with the formation is accomplished by means of an outer snorkel tube 215 and an inner snorkel tube 217. The two tubes are independently movable, the inner snorkel tube 217 having the capability of penetrating deeper into the formation. Means for operating snorkel tubes of this kind would be familiar to those knowledgeable in the art.

The inner snorkel tube 217 is connected to probe flowline 223*a* while the region between the inner snorkel tube 217 and the outer snorkel tube 215 defines a guard zone that is connected to the guard flowline 223*b*. Flowlines 223*a* and 223*b* are provided with pumps and sample chambers (not shown). The inner snorkel tube 217 defines a probe zone that is isolated by the outer snorkel tube 215 from the portion of the borehole outside the outer snorkel tube. These pumps are operated long enough to substantially deplete the invaded zone in the vicinity of the outer snorkel tube 215 and to establish an equilibrium condition in which the fluid flowing into the inner snorkel tube is substantially free of contaminating borehole filtrate. When the equilibrium condition is reached, contaminated fluid is drawn into the guard zone and uncontaminated fluid is drawn into the inner snorkel tube. At this time, sampling is started with the pumps continuing to operate for the duration of the sampling. As sampling proceeds, the borehole fluid continues to flow from the borehole towards the probe, while the contaminated fluid is preferentially drawn into the outer snorkel tube. Pumps (not shown) discharge the contaminated fluid into the borehole. The fluid from the inner snorkel tube is retrieved to provide a sample of the formation fluid.

Figure 5A:
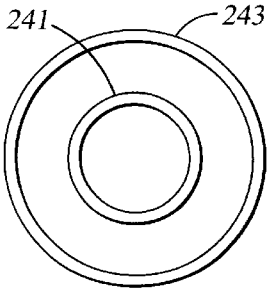
FIG. 5 illustrates some possible arrangements of the tubes in the invention of FIG. 4.
Figure 5B:
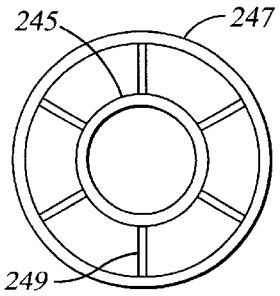
Figure 5C:
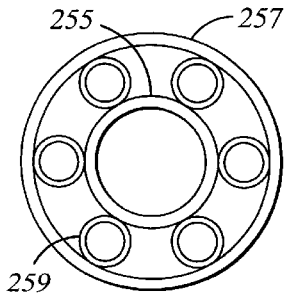

FIGS. 5*a*–5*c* show alternative arrangements of the snorkel tube. In FIG. 5*a*, the inner snorkel tube 241 and the outer snorkel tube 243 are shown as concentric cylinders. In FIG. 5*b*, the annular region between the inner snorkel tube 245 and the outer snorkel tube 247 is segmented by means of a plurality of dividers 249. FIG. 5*c* shows an arrangement in which the guard zone is defined by a plurality of tubes 259 interposed between the inner snorkel tube 255 and the outer snorkel tube 257. In any of these configurations, a wire mesh or a gravel pack may also be used to avoid damage to the formation.

Figure 6:
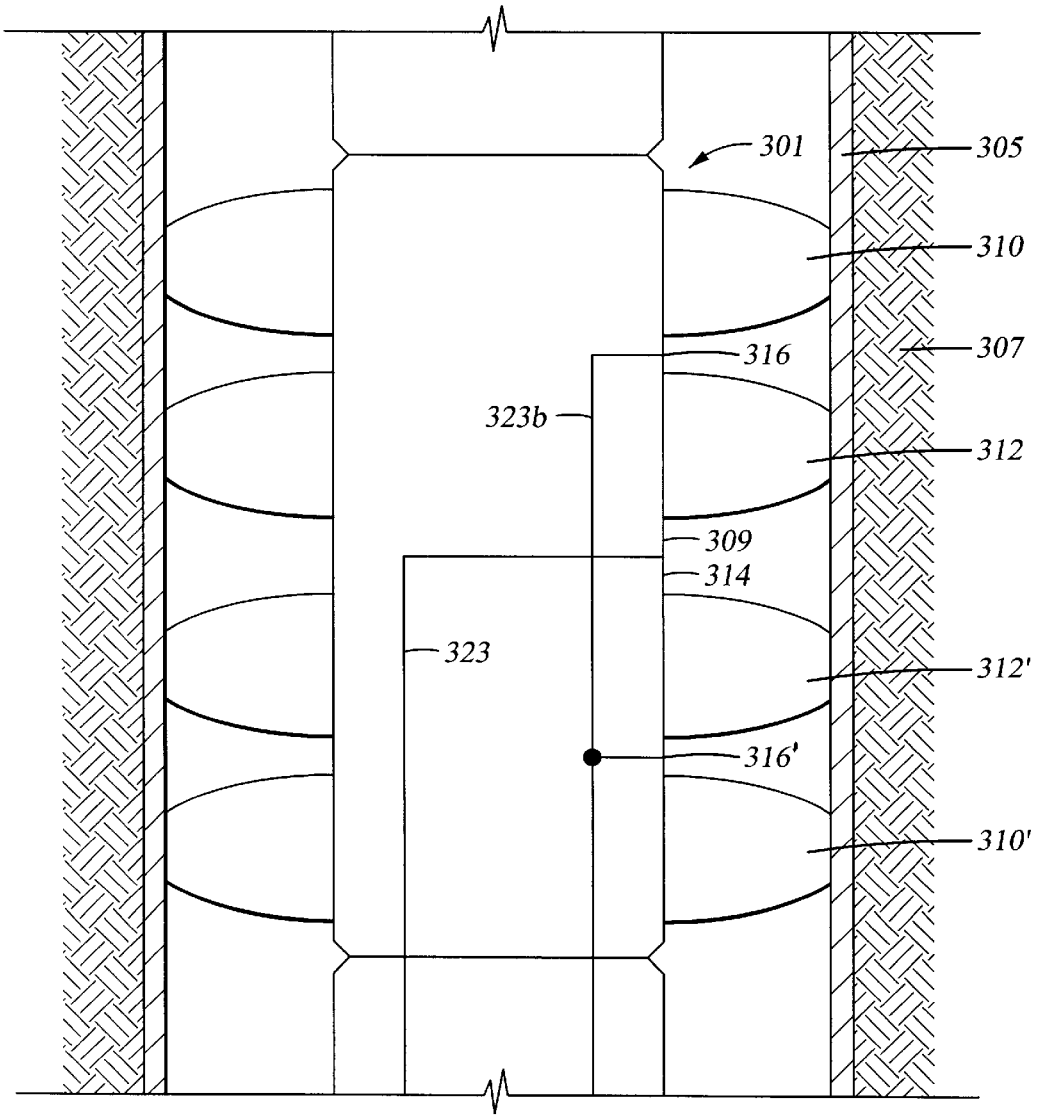
FIG. 6 is a simplified schematic illustration of the invention for use in a drilling Early Evaluation System using inflatable packers on a drill pipe.

FIG. 6 shows an alternative EES tool that uses short packers instead of the snorkel tubes. The packers may be inflatable or may be expandable metal packers. A portion of a borehole 301, is shown in a subterranean formation, 307. The borehole wall is shown at 305. The formation tester body 309, is connected to a drilling apparatus. The EES tool is provided with short flow packers 312 and 312' and guard packers 310 and 310'. The zone between the flow packers 312 and 312' defines the probe zone while the zone between the flow packers and the guard packers 310 and 310' defines the guard zone. When the formation tester is at the depth at which formation fluids are to be sampled, the inflatable packers 310, 310', 312 and 312' are inflated to form a tight seal with the borehole wall 305. The mechanism for activating the packers would be familiar to those versed in the art. Thus three zones are defined in the borehole: a first zone consisting of the borehole above the packer 310 and below the packer 310', a second zone (the guard zone) consisting of the region between the packers 310 and 312 and between the packer 310' and 312'; and a third zone (probe zone) consisting of the zone between the packers 312 and 312'. The probe zone is isolated from the first zone by the guard zone.

A hydraulic flow line (probe flowline), 323, is connected to an opening, 314, in the tester located in the probe zone and to a pump (not shown). This serves to sample formation fluid that flows into the borehole between the two flow packers. A second hydraulic flow line (guard flowline), 323*b*, is connected to openings 316 and 316' in the tester located between the guard zone. The pumps are operated long enough to substantially deplete the invaded zone in the vicinity of the pad and to establish an equilibrium condition in which the fluid flowing into the inner snorkel tube is substantially free of contaminating borehole filtrate. As sampling proceeds, if the borehole fluid continues to flow from the borehole towards the probe, the contaminated fluid is preferentially drawn into the guard ring. Pumps (not shown) discharge the sampled fluid into the borehole. At some time, an equilibrium condition is reached in which contaminated fluid is drawn into the guard zone and uncontaminated fluid is drawn into the inner snorkel tube. This fluid is retrieved to provide a sample of the formation fluid. The pumps continue to operate during the process of retrieval of the formation fluid from the inner snorkel tube.

The walls of the packers need only be thick enough to provide the necessary structural arrangement wherein the flow into the inner tube is isolated from the flow outside; this means that problems encountered in prior art where, in the absence of a mudcake, leakage occurs around the packers is circumvented.

EXAMPLES

Figure 7:
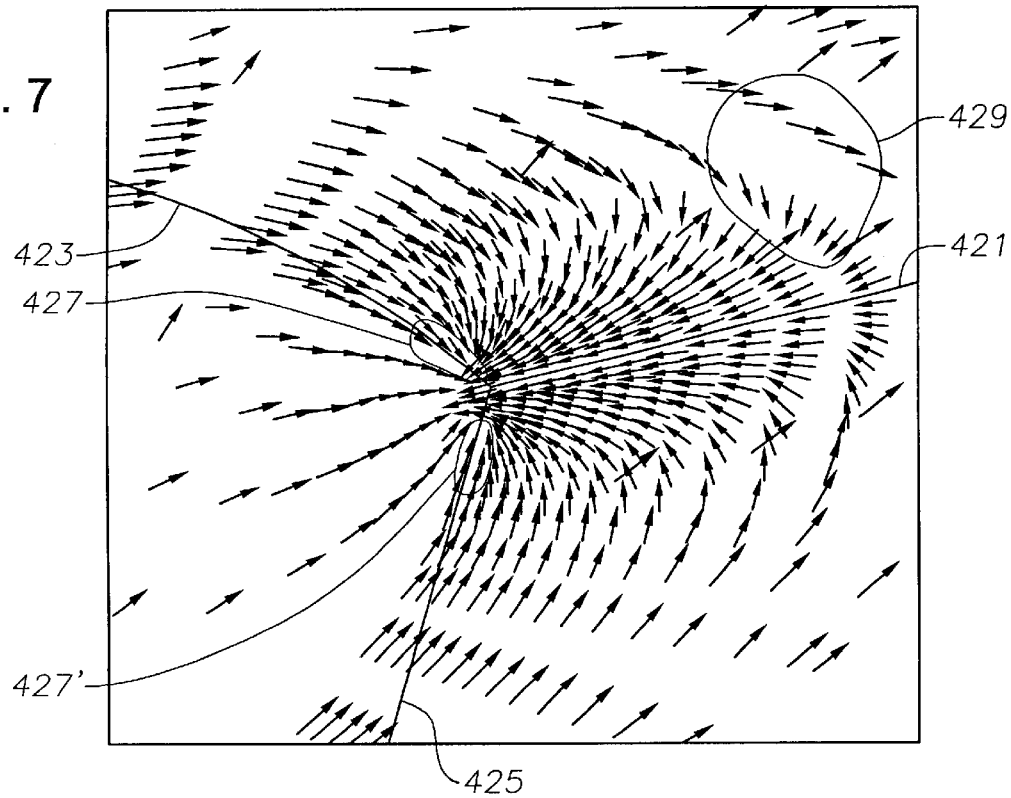
FIG. 7 shows the simulation of fluid flow in a prior art device.
Figure 8:
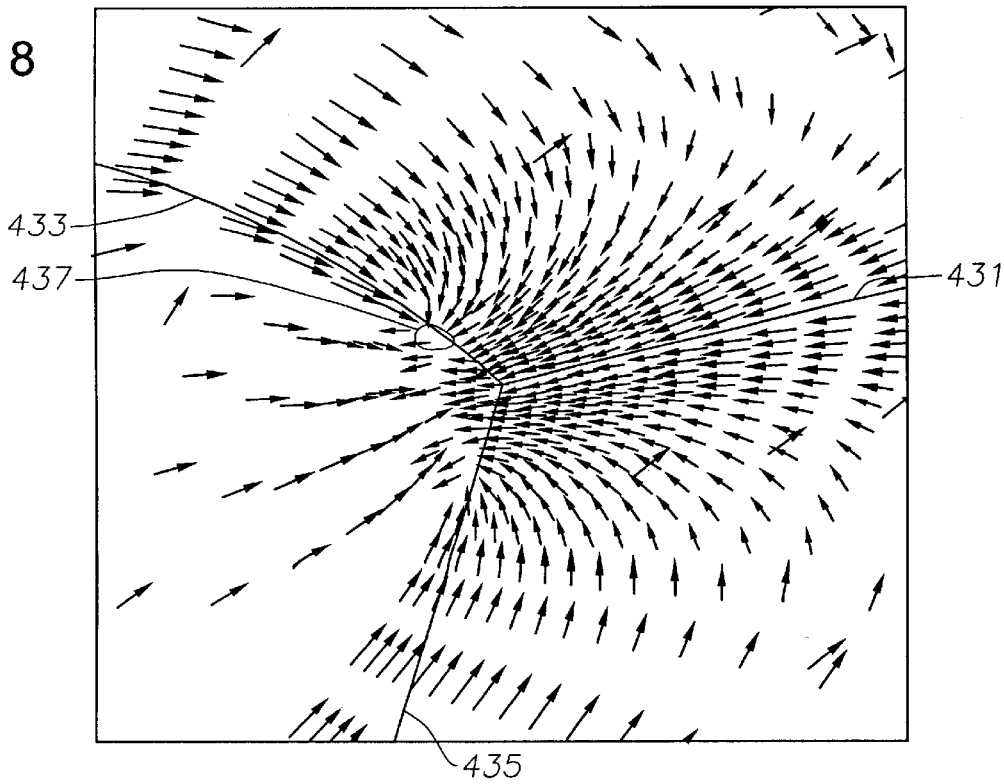
FIG. 8 shows a simulation of the direction of fluid flow in the vicinity of a fluid sampling pad.

The effectiveness of the focused type probe is demonstrated by the results of a finite element simulation shown in FIGS. 7 and 8. In both figures, one fourth of the pad area is shown with the remaining portion cut away to see into the formation. FIG. 7 is for the simulation of an unfocussed flow, i.e., a conventional probe according to prior art. In FIG. 7, the direction labeled 421 is radial and into the formation, 425 follows the borehole wall vertically and 423 follows the borehole wall circumferentially. The center of the probe is at the intersection of 421, 423 and 425. The arrows in FIG. 7 show the direction of fluid flow in the simulation. The zones labeled 427 and 427' show that borehole fluid is flowing into the probe and contaminating the fluid drawn into the probe. In addition, the zone labeled as 429 generally corresponds to borehole fluids that have invaded the formation and are flowing back into the probe.

FIG. 8 is for the simulation of a focused flow, i.e., a probe according to the present invention. The direction labeled 431 is radial and into the formation, 435 follows the borehole wall vertically and 433 follows the borehole wall circumferentially. The center of the probe is at the intersection of 431, 433 and 435. The arrows in show the direction of fluid flow in the simulation. It can be seen in FIG. 8 that in the zones corresponding to 427 and 427' in FIG. 7, the flow direction is radial, i.e., the borehole fluid is not being drawn into the probe. Instead, the borehole fluid flows into the zone labeled as 437. This corresponds to the position of the guard ring, packer or snorkel tube. Furthermore, in the zone corresponding to 429 in FIG. 7, the flow direction is radial, indicating that the probe is effectively draining fluid from deeper into the formation with less contamination by invaded borehole fluids.

The foregoing description has been limited to specific embodiments of this invention. It will be apparent, however, that variations and modifications may be made to the disclosed embodiments, with the attainment of some or all of the advantages of the invention. Therefore, it is the object of the appended claims to cover all such variations and modifications as come within the true spirit and scope of the invention.

What is claimed is:

1. A formation tester tool for retrieving a formation fluid from a formation surrounding a wellbore having a drilling fluid, comprising:

(a) a first element adapted to retrieve the formation fluid from a first (probe) zone in the formation, the first element having a first controlled pressure; and (b) an isolation device, said isolation device defining a second (guard) zone adjacent the probe zone said second guard zone being maintained at a second controlled pressure, the first and second pressures being varied such that the flow of drilling fluid into the probe zone is reduced; and (c) a device for retrieving fluid from the guard zone.

2. The formation tester tool of claim 1, wherein the first element is a probe adapted to contact the formation; and wherein the isolation device is a guard ring surrounding the probe, the guard ring having at least one opening that is in fluid communication with the formation.

3. The formation tester tool of claim 1 wherein the isolation device is a guard ring.

4. The formation tester tool of claim 3 further comprising a guard flow line connected to the guard zone.

5. The formation tester tool of claim 4 further comprising:

a probe flow line connected to the probe zone;

a first fluid analysis device in the probe flow line; and a second fluid analysis device in the guard flow line.

6. The formation tester tool of claim 1 wherein the first element comprises a pair of probe packers adapted to engage the walls of the borehole defining the probe zone therebetween and the isolation device comprises a pair of guard packers disposed about the pair of probe packers, said guard packers adapted to engage the walls of the borehole and define the guard zone between each of the probe packers and the adjacent guard packer.

7. The formation tester tool of claim 6 further comprising a probe flow line connected to the probe zone.

8. The formation tester tool of claim 7 wherein the tool is adapted to be used on a wireline.

9. The formation tester tool of claim 7 wherein the tool is adapted to be used on a drillstring.

10. The formation tester tool of claim 8, further comprising a first control device for controlling fluid flow into the probe flow line and a second control device for controlling fluid flow into the second line.

11. The formation tester tool of claim 10, wherein the first control device maintains a first pressure in the probe flow line and the second control device maintains a second pressure in the guard flow line, the second pressure being less than or equal to the first pressure.

12. The formation tester tool of claim 11, further comprising a first fluid analysis device in the probe flow line.

13. The formation tester tool of claim 1, wherein the first element comprises an inner snorkel tube adapted to penetrate the formation and the isolation device comprises an outer snorkel tube adapted to penetrate the formation.

14. The formation tester tool of claim 13 wherein the tool is adapted to be used on a drillstring.

15. The formation tester tool of claim 5, further comprising a probe fluid sample chamber connected to the probe flow line.

16. The formation tester tool of claim 15, wherein the formation fluid tester is adapted to be used on a wireline.

17. A method for retrieving a formation fluid from a formation surrounding a wellbore having a contaminating fluid, comprising:

conveying a formation tester into the wellbore, said formation tester defining a probe zone and a guard zone adjacent the formation;

controlling the pressures of the probe zone and guard zone such that the guard zone pressures is the same as or lower than the probe zone pressure; and retrieving formation fluid from the probe zone.

18. The method of claim 17, further comprising:

(a) connecting a guard flow line to the guard zone;

(b) connecting a probe flow line to the probe zone.

19. The method of claim 17, further comprising:

(a) expanding a pair of guard packers on the formation tester to engage the walls of the borehole; and (b) expanding a pair of probe packers on the formation tester to engage the walls of the borehole and defining the probe zone therebetween, the probe packers being disposed between the guard packers and defining the guard zone between each of the probe packers and the adjacent guard packer.

20. The method of claim 19 further comprising operating the formation tester on a wireline.

21. The method of claim 19 further comprising operating the formation tester on a drillstring drillstring.

22. The method of claim 19 further comprising:

(a) activating an inner tube on the formation tester to penetrate the formation to define the probe zone, and (b) activating an outer tube on the formation tester to penetrate the formation, to define the guard zone by the region between the first tube and the second tube.

23. The method of claim 17, further comprising:

retrieving fluid from the guard zone; and comparing the probe zone fluid with the guard zone fluid.

24. The method of claim 23, further comprising:

determining when the probe zone fluid is substantially free of contaminating fluid; and collecting probe zone fluid into a probe sample chamber.

25. The method of claim 24, further comprising discharging the guard zone fluid into the formation.

26. The method of claim 24, further comprising collecting the guard zone fluid into a guard sample chamber.

27. A method for retrieving a formation fluid from a formation surrounding a wellbore having a drilling fluid comprising:

conveying a formation tester into the wellbore, said formation tester defining a probe zone and a guard zone adjacent the formation;

operating the formation tester to retrieve fluid from the guard zone and reducing the flow of the drilling fluid into the probe zone; and retrieving fluid from the probe zone;

connecting a guard flow line to the guard zone;

connecting a probe flow line to the probe zone; and lowering the pressure in the guard flow line to below the pressure of the probe flow line.

28. The method of claim 27 further comprising determining when the fluid in the probe flow line is substantially free of drilling fluids.

29. A formation tester tool for retrieving a formation fluid from a formation surrounding a wellbore having a drilling fluid, comprising:

a probe adapted to retrieve the formation fluid from a first (probe) zone in the formation;

a probe flow line associated with the probe:

a guard ring, said guard ring defining a second (guard) zone adjacent the probe zone;

a guard flow line associated with the guard ring;

a first pump adapted to control pressure in the probe flow line; and a second pump adapted to control pressure in the guard flow line.

a device for retrieving fluid from the guard zone in order to reduce the flow of the drilling fluid into the probe zone.

30. The formation tester tool of claim 29, wherein the first pump maintains a first pressure in the probe flow line and the second pump maintains a second pressure in the guard flow line, the first pressure and second pressures maintained such that drilling fluid is diverted from the probe zone.

31. The formation tester tool of claim 30, further comprising first and second fluid identification sensors in fluid communication with the probe and guard zone flow lines, respectively.

32. The formation tester tool of claim 31, further comprising a sample chamber adapted to receive fluid from the probe flow line.

33. A formation tester tool for retrieving a formation fluid from a formation surrounding a wellbore having a drilling fluid comprising:

a probe adapted to contact said the formation and retrieve the formation fluid from a first (probe) zone in the formation;

a guard ring, said guard ring defining a second (guard) zone adjacent the probe zone;

a guard flow line connected to the guard zone for retrieving fluid from the guard zone;

a probe flow line connected to the probe zone; and a first control device for controlling fluid flow into the probe flow line and a second control device for controlling fluid flow into the guard flow line, wherein the first control device maintains a first pressure in the probe flow line and the second control device maintains a second pressure in the guard flow line, the first pressure being greater than or equal to the second pressure.

34. The formation tester tool of claim 33, further comprising a first fluid analysis device in the probe flow line and a second fluid analysis device in the guard flow line.

35. The formation tester tool of claim 34 further comprising a probe fluid sample chamber connected to the probe flow line.

36. The formation tester tool of claim 35 wherein the formation tester tool is adapted to be used on a wireline.

37. A formation tester tool for retrieving a formation fluid from a formation surrounding a wellbore having a drilling fluid, comprising:

a probe adapted to retrieve the formation fluid from a first (probe) zone in the formation;

a guard ring said guard ring defining a second (guard) zone adjacent the probe zone; and a device for retrieving fluid from the guard zone in order to reduce the flow of the drilling fluid into the probe zone;

a probe flow line in fluid communication with the probe zone;

a first control device for controlling fluid flow into the probe flow line; and a second control device for controlling fluid flow into the guard flow line;

wherein the first control device maintains a first pressure in the probe flow line and the second control device maintains a second pressure in the guard flow line, the first pressure being greater than or equal to the second pressure.

38. A fluid sampling tool for retrieving a first fluid from a first zone where an adjacent second zone has a second fluid, comprising:

a tool body having a first chamber the first chamber adapted to receive the first fluid;

a probe having a first portion for penetrating the first zone, the probe having a probe flow line in fluid communication with the first chamber;

the probe flow line having a first controlled flow rate; and a guard ring circumferentially disposed around the probe, the guard including a guard flow line, the guard flow line having a second controlled flow rate the first and second controlled flow rates varied such that the flow of the second fluid into the first zone is reduced.

39. The fluid sampling tool of claim 38 further comprising a first fluid analysis device in the probe flow line and a second fluid analysis device in the guard flow line.

40. The fluid sampling tool of claim 38 further comprising a guard fluid sample chamber connected to the guard flow line.

41. The fluid sampling tool of claim 38 wherein the formation tester tool is adapted to be used on a wireline.

42. A formation tester tool for retrieving a formation fluid from a formation surrounding a wellbore having a drilling fluid, comprising:

(a) a first element adapted to retrieve the formation fluid from a first probe zone in the formation, the first element having a first controlled pressure; and (b) an isolation device, said isolation device defining, a second zone adjacent the probe zone, the isolation device having a second controlled pressure the first pressure being greater than or equal to the second pressure, thereby creating a fluid retrieval condition where the flow of drilling fluid into the first probe zone is reduced; and (c) a device for retrieving formation fluid from the second zone.

43. The formation tester tool of claim 42, wherein the first element is a probe adapted to contact the formation; and wherein the isolation device is a guard ring surrounding the probe, the guard ring having at least one opening being in contact with the formation.

44. The formation tester tool of claim 43 further comprising a guard flow line connected to the guard zone.

45. The formation tester tool of claim 44, further comprising:

a probe flow line connected to the probe zone;

a first fluid analysis device in the probe flow line; and a second fluid analysis device in the guard flow line.

46. A method for retrieving a formation fluid from a formation surrounding a wellbore having a contaminating fluid, comprising:

positioning a formation tester in the wellbore, said formation tester defining a probe zone and a guard zone adjacent the formation;

varying the pressure in the probe zone and guard zone such that the contaminating fluid is drawn from the formation into the guard zone, thereby creating a fluid retrieval condition where the flow of contaminating fluid into the probe zone is reduced; and retrieving formation fluid from the probe zone.

47. The method of claim 46 further comprising determining when the fluid in the probe flow line is substantially free of drilling fluids.

* * * * *